US007266909B2

(12) United States Patent
Liang

(10) Patent No.: US 7,266,909 B2
(45) Date of Patent: Sep. 11, 2007

(54) INSOLE EMBEDDED WITH GERMANIUM

(76) Inventor: Chia-Ing Liang, No.27-3, Weisinjhuang, Changhua City (TW)

( * ) Notice: Subject to any disclaimer, the term of this patent is extended or adjusted under 35 U.S.C. 154(b) by 435 days.

(21) Appl. No.: 11/023,374

(22) Filed: Dec. 29, 2004

(65) Prior Publication Data

US 2006/0137222 A1 Jun. 29, 2006

(51) Int. Cl.
*A43B 13/38* (2006.01)

(52) U.S. Cl. ..... 36/43; 36/3 B

(58) Field of Classification Search ..... 36/43, 36/141, 3 B, 44

See application file for complete search history.

(56) References Cited

U.S. PATENT DOCUMENTS 5,261,169 A * 11/1993 Williford ..... 36/43
5,690,922 A * 11/1997 Mouri et al. ..... 424/76.1
5,753,357 A * 5/1998 Filipitsch et al. ..... 428/307.7
2004/0244224 A1* 12/2004 Yoon ..... 36/44

FOREIGN PATENT DOCUMENTS

EP 315044 A1 * 5/1989

* cited by examiner

*Primary Examiner*—Ted Kavanaugh
(74) *Attorney, Agent, or Firm*—Troxell Law Office PLLC

(57) ABSTRACT

An insole embedded with germanium includes a upper layer, a lower layer and a germanium-plated blade interposed between the upper layer and the lower layer. The germanium-plated blade includes a metal sheet covered by a germanium-plated layer. The germanium element of the germanium-plated blade can release drifting negative electrons to prevent breeding of microbes and improve blood circulation of user's sole.

2 Claims, 2 Drawing Sheets

INSOLE EMBEDDED WITH GERMANIUM

BACKGROUND OF THE INVENTION

1. Field of the Invention

The invention relates to an insole embedded with germanium that has a upper layer and a lower layer interposed by one or more germanium plated blade which can release negative germanium electrons to balance positive and negative electrons to prevent foul odor in the shoe and produce disinfection effect and improve blood circulation of user's sole.

2. Description of the Prior Art

There are many types of insoles or shoe inserts on the market. Some aim to remove bad smell and prevent breeding of microbes. Due to constant advance of biotechnology, applications of new elements have been discovered continuously. The most notable examples are applications of nanotechnology and germanium. The germanium has been proved can remove foul odor, prevent breeding of bacteria and improve blood circulation. Hence how to use germanium on the insole has been an issue pursued in the industry.

SUMMARY OF THE INVENTION

It is known that negative electrons of germanium tend to break loose and drift at 32 degree C. This characteristic can be used to balance the positive and negative electrons of foot and prevent foul odor and microbes breeding on the foot when wearing shoes, and improve blood circulation of the foot. But germanium is a rare and expensive metal. In practice, a small amount of germanium can achieve the effect of removing foul odor, disinfection and improving blood circulation. How to effectively deploy germanium at a lower cost is an issue yet to be overcome.

In view of the aforesaid concerns, the present invention aims to provide an insole embedded with germanium that includes a upper layer and a lower layer that are interposed by one or more germanium plated blade. The germanium plated blade includes a metal sheet covered by a plated germanium layer. The structure thus formed can prevent foul odor and microbes from breeding in the shoe and improve blood circulation of user's sole.

The foregoing, as well as additional objects, features and advantages of the invention will be more readily apparent from the following detailed description, which proceeds with reference to the accompanying drawings.

DESCRIPTION OF THE PREFERRED EMBODIMENT

Figures 1, 2:
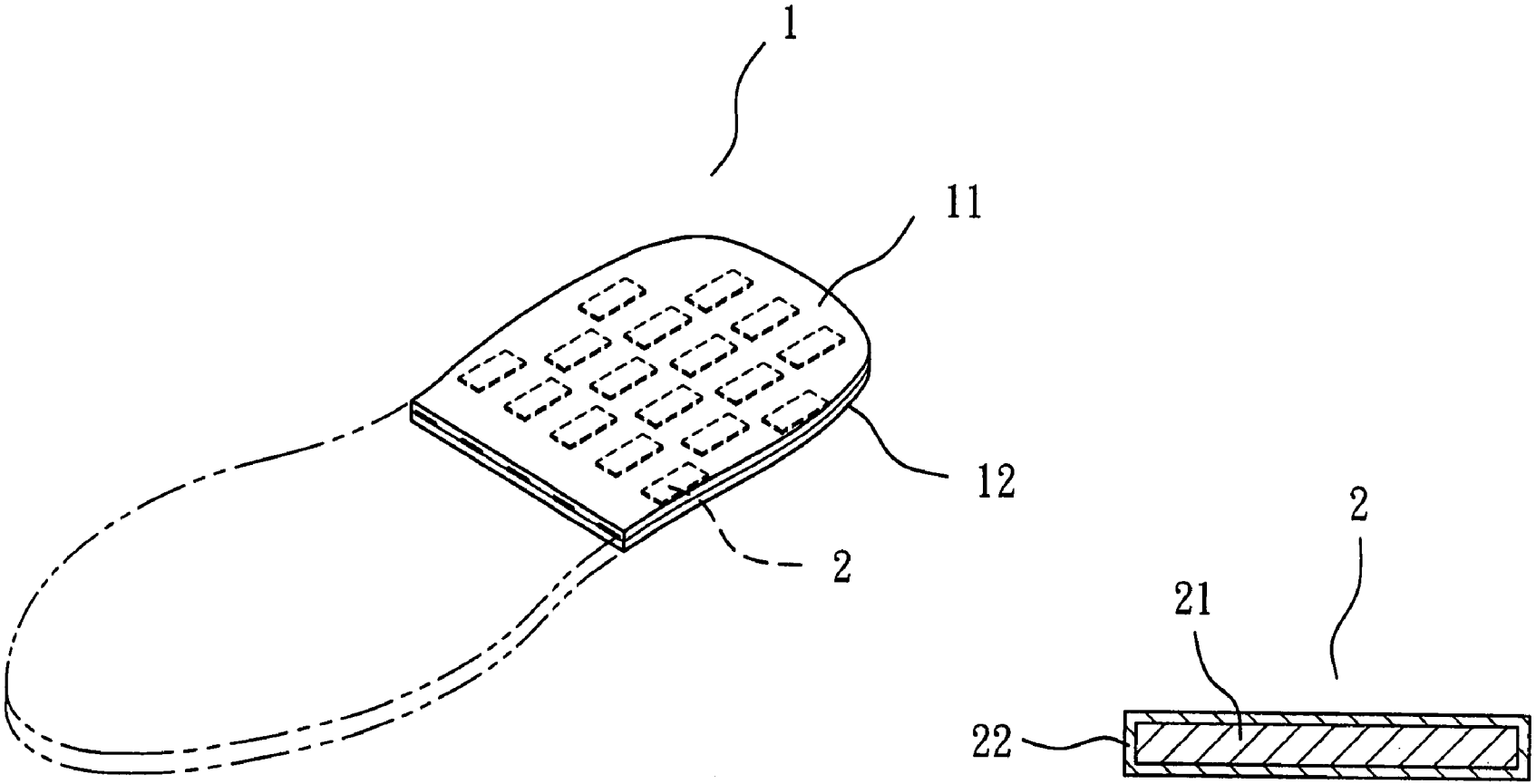
FIG. 1 is a schematic view of the insole of the invention.
FIG. 2 is a sectional view of the germanium blade of the invention.

Referring to FIGS. 1 and 2, the insole 1 according to the invention includes a upper layer 11 and a lower layer 12 that are interposed by one or more germanium-plated blade 2. The germanium plated blade 2 has a metal sheet 21 covered by a germanium-plated layer 22.

Figure 3:
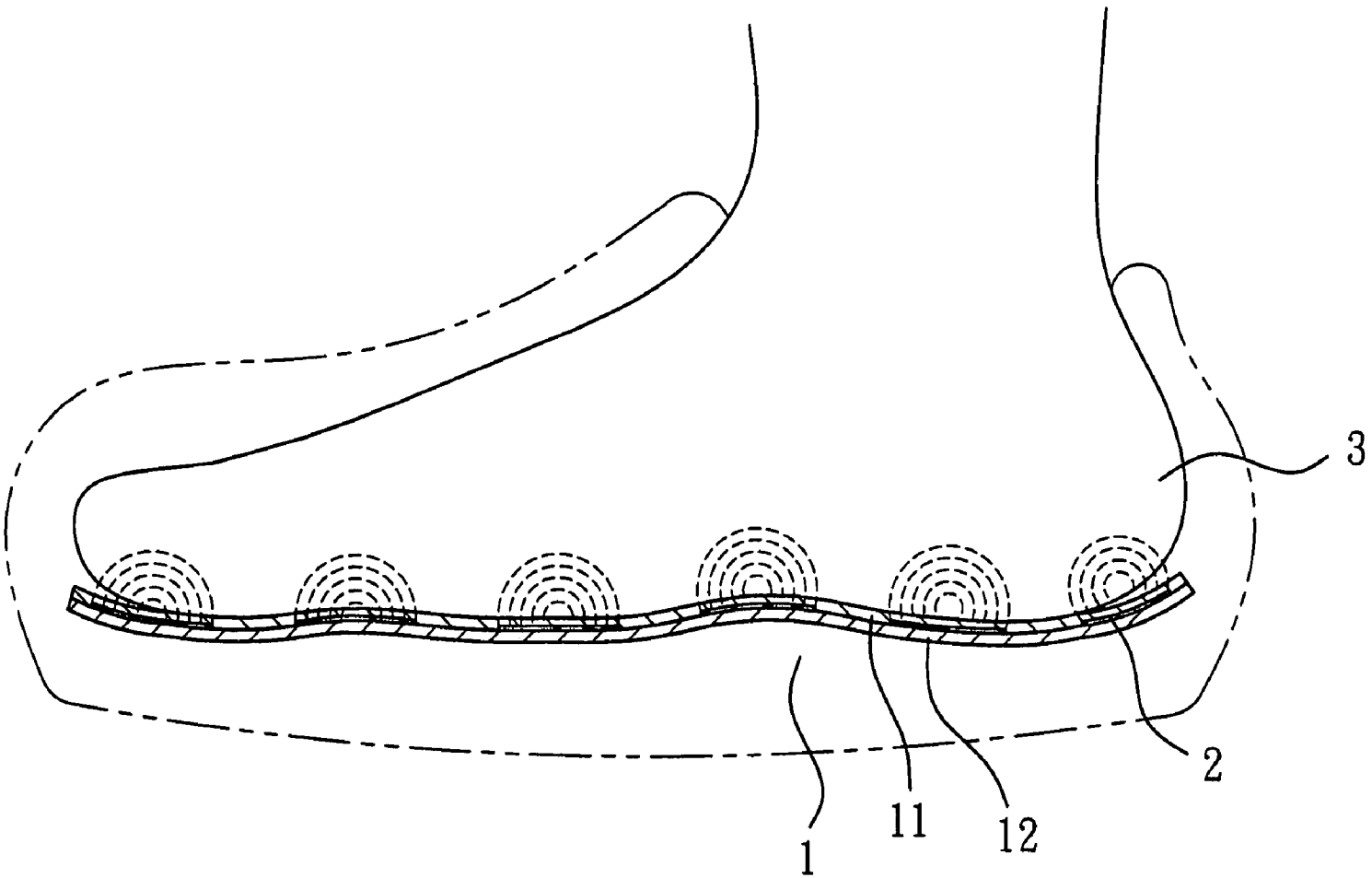
FIG. 3 is a schematic view of an embodiment of the invention.

Referring to FIG. 3, when in use, the germanium element on the germanium-plated blade 2 will release drifting negative electrons at 32 degree C. When a user's foot is in contact with the insole, the negative germanium electrons are released from the germanium-plated blade 2 due to physical property. As the foul odor and microbes breed mainly due to the imbalance of the positive and negative electricity caused by loss of negative electrons from the foot, and blood circulation of the foot suffers. As a result, undesirable chemicals are generated. The negative electrons released by the germanium element can replenish the lost negative electrons, thus balance the negative electrons of the foot 3. Therefore foul odor may be prevented, and disinfection effect is achieved. And blood circulation of user's sole improves.

Moreover, the germanium blade 2 may be distributed between the upper and lower layers according to the vital points of the sole to further improve the effect of the released negative electrons of germanium.

In summary, by deploying a germanium blade in the insole, the cost of using germanium may be reduced. It also can prevent foul odor and microbes from breeding in the shoe and improve blood circulation of user's sole.

I claim:

1. An insole embedded with germanium comprising a upper layer, a lower layer and a germanium-plated blade interposed between the upper layer and the lower layer, the germanium-plated blade including a metal sheet covered by a germanium-plated layer.

2. The insole embedded with germanium of claim 1, wherein the germanium-plated blade is distributed according to the vital points of a sole.

* * * * *